US007842173B2

(12) United States Patent
McHugh et al.

(10) Patent No.: US 7,842,173 B2
(45) Date of Patent: Nov. 30, 2010

(54) APPARATUS AND METHODS FOR ELECTROCHEMICAL PROCESSING OF MICROFEATURE WAFERS

(75) Inventors: Paul R. McHugh, Kalispell, MT (US); Gregory J. Wilson, Kalispell, MT (US); Daniel J. Woodruff, Kalispell, MT (US)

(73) Assignee: Semitool, Inc., Kalispell, MT (US)

( * ) Notice: Subject to any disclaimer, the term of this patent is extended or adjusted under 35 U.S.C. 154(b) by 870 days.

(21) Appl. No.: 11/699,768

(22) Filed: Jan. 29, 2007

(65) Prior Publication Data

US 2008/0179180 A1 Jul. 31, 2008

(51) Int. Cl.
*C25B 9/00* (2006.01)

(52) U.S. Cl. ..... 204/272; 204/260

(58) Field of Classification Search ..... 205/96, 205/97; 204/194, 242, 260, 261, 272, 273
See application file for complete search history.

(56) References Cited

U.S. PATENT DOCUMENTS

| | | | | |
|---|---|---|---|---|
| 5,681,448 | A | 10/1997 | Uchiyama et al. | |
| 6,080,291 | A | 6/2000 | Woodruff et al. | |
| 6,103,033 | A | 8/2000 | Say et al. | |
| 6,261,433 | B1 * | 7/2001 | Landau | 205/96 |
| 6,270,647 | B1 | 8/2001 | Graham et al. | |
| 6,428,673 | B1 | 8/2002 | Ritzdorf et al. | |
| 6,527,925 | B1 | 3/2003 | Batz, Jr. et al. | |
| 6,565,729 | B2 * | 5/2003 | Chen et al. | 205/82 |
| 6,569,297 | B2 | 5/2003 | Wilson et al. | |
| 6,654,122 | B1 | 11/2003 | Hanson et al. | |
| 6,660,137 | B2 | 12/2003 | Wilson et al. | |
| 6,773,560 | B2 | 8/2004 | Pedersen et al. | |
| 6,916,412 | B2 | 7/2005 | Woodruff et al. | |

(Continued)

FOREIGN PATENT DOCUMENTS

WO 2004110698 A2 12/2004

OTHER PUBLICATIONS

International Search Report and Written Opinion of the International Searching Authority in PCT International Application No. PCT/US 08/52104, dated Jul. 28, 2008.

(Continued)

*Primary Examiner*—Luan V Van
(74) *Attorney, Agent, or Firm*—Kenneth H. Ohriner; Perkins Coie LLP

(57) ABSTRACT

Apparatus and methods for electrochemically processing microfeature wafers. The apparatus can have a vessel including a processing zone in which a microfeature wafer is positioned for electrochemical processing. The apparatus further includes at least one counter electrode in the vessel that can operate as an anode or a cathode depending upon the particular plating or electropolishing application. The apparatus further includes a supplementary electrode and a supplementary virtual electrode. The supplementary electrode is configured to operate independently from the counter electrode in the vessel, and it can be a thief electrode and/or a de-plating electrode depending upon the type of process. The supplementary electrode can further be used as another counter electrode during a portion of a plating cycle or polishing cycle. The supplementary virtual electrode is located in the processing zone, and it is configured to counteract an electric field offset relative to the wafer associated with an offset between the wafer and the counter electrode in the vessel when the wafer is in the processing zone.

24 Claims, 8 Drawing Sheets

U.S. PATENT DOCUMENTS

| | | | |
|---|---|---|---|
| 7,020,537 | B2 | 3/2006 | Wilson et al. |
| 7,125,477 | B2 | 10/2006 | Butterfield et al. |
| 7,160,421 | B2 | 1/2007 | Wilson et al. |
| 7,189,318 | B2 | 3/2007 | Wilson |
| 7,198,694 | B2 | 4/2007 | Woodruff |
| 7,264,698 | B2 | 9/2007 | Hanson |
| 2003/0020928 | A1 | 1/2003 | Ritzdorf et al. |
| 2003/0038035 | A1 | 2/2003 | Wilson et al. |
| 2003/0062258 | A1 | 4/2003 | Woodruff et al. |
| 2004/0245094 | A1 | 12/2004 | McHugh et al. |
| 2005/0000817 | A1 | 1/2005 | McHugh et al. |
| 2005/0006241 | A1 | 1/2005 | McHugh et al. |
| 2005/0050767 | A1 | 3/2005 | Hanson et al. |
| 2005/0056538 | A1 | 3/2005 | Kovarsky et al. |
| 2005/0087439 | A1 | 4/2005 | Hanson et al. |
| 2005/0121317 | A1 | 6/2005 | Klocke et al. |
| 2005/0121326 | A1 | 6/2005 | Klocke et al. |
| 2005/0145499 | A1 | 7/2005 | Kovarsky et al. |
| 2005/0253206 | A1 | 11/2005 | Bureau et al. |
| 2005/0284751 | A1 | 12/2005 | Kovarsky et al. |
| 2006/0144699 | A1 | 7/2006 | Klocke |
| 2006/0289302 | A1 | 12/2006 | Hanson |
| 2007/0151844 | A1 | 7/2007 | Wilson et al. |

OTHER PUBLICATIONS

The Linear Motion Solution, Rollon Inear Volution; http://www.rolloncorp.com/products/compact_rail/index.shtml (3 pages).

* cited by examiner

APPARATUS AND METHODS FOR ELECTROCHEMICAL PROCESSING OF MICROFEATURE WAFERS

TECHNICAL FIELD

This application relates to apparatus and methods for electroplating and/or electropolishing microfeature wafers that have a plurality of microfeatures integrated in and/or on the wafers. Particular apparatus and methods of the present invention ameliorate non-uniformities caused by misalignment between the wafer and the electrodes, provide good control of the current density across the wafer, mitigate particle contamination, and reduce the downtime for cleaning thief electrodes in electrochemical processes used in the manufacturing of semiconductor devices, imagers, storage media and other products.

BACKGROUND

Microelectronic devices, such as semiconductor devices, imagers, displays, storage media, and micromechanical components, are generally fabricated on and/or in microfeature wafers using a number of processes that deposit and/or remove materials from the wafers. Electroplating is one such process that deposits conductive, magnetic or electrophoretic layers on the wafers. Electroplating processes, for example, are widely used to form small copper interconnects or other very small sub-micron features in trenches and/or holes (e.g., less than 90 nm damascene copper lines). Electropolishing is another process that removes material from a wafer. In both of these processes, an electrical current is passed between the wafer and one or more counter electrodes in a manner that deposits or removes material from a surface of the wafer.

One challenge of plating materials into narrow, deep recesses is that it is very difficult to completely fill the very small features and create a desired surface profile on the plated layer (e.g., uniformly planar, domed, etc.). For example, as the performance of microelectronic products increase, the aspect ratios and densities of the recesses substantially increases. To adequately fill such small, high density recesses with high aspect ratios, existing plating practices often plate a metal onto a very thin seed layer or directly onto a barrier layer. Thin seed layers and barrier layers, however, typically have relatively high resistances that cause a significant drop in current density from the edge of the wafer to the center during the initial stages of a plating cycle. The plating rate at the edge of the wafer is accordingly significantly higher than the center during the initial portion of the plating process, which causes the plated material at the edge of the wafer to be substantially thicker than the middle. This edge effect is further exacerbated by the higher densities and higher aspect ratios of the recesses. Therefore, reducing or eliminating the edge effect is a significant challenge that needs to be addressed to develop faster, higher performance semiconductor devices and other microfeature devices.

Several existing plating tools have reactors with a thief electrode attached to the wafer holder to mitigate the edge effect caused by high resistance of the wafer or by the geometry of the chamber. The thief electrode is biased at the same polarity as the wafer such that it modifies the electric field in the perimeter region of the wafer. The thief electrode accordingly reduces the plating rate at the perimeter of the wafer to compensate for the edge effect. Although such systems may mitigate the edge effect, they also have several disadvantages. First, particles that build up on the thief electrode may eventually become dislodged, and the close proximity of the thief electrode increases the likelihood that the dislodged particles will plate or otherwise adhere to the wafer. Moreover, it is difficult to minimize the formation of particles on a thief electrode attached to a wafer holder because the thief electrode is removed from the bath to unload finished wafers and load new wafers, and then the thief is reintroduced into the plating bath with each new wafer. Such wetting and drying of the film on the thief can make it difficult to control the quality of film on the wafer and minimize particles. It is also difficult to clean and maintain thief electrodes when they are attached to the wafer holder. This is problematic because thief electrodes must be cleaned relatively often, and it requires a significant amount of time and effort to detach the thief electrode from the wafer holder. Therefore, existing systems with thief electrodes carried by the wafer holder have several drawbacks.

Other types of systems have a plurality of anodes, a thief electrode separate from the wafer holder, and a virtual thief electrode defined by an aperture having a fixed size under the wafer. Such systems with detached thief electrodes generally position the thief electrode in the bottom portion of the reactor vessel. The present inventors have discovered that systems with virtual thief openings improve the performance of the reactors, but they also present additional challenges. One improvement is that dislodged particles from the thief electrode are not as likely to plate onto the wafer because thief electrode is not as close to the wafer. However, one disadvantage of not attaching the thief electrode to the wafer holder is that the systems are sensitive to misalignment between the wafer holder and the thief electrode or the anode(s). This is because the thief electrodes are fixed relative to the vessels of the chamber, but the wafer holder and vessel may not be properly aligned with each other, which causes misalignment between the wafer holder and the thief electrode or the anode(s). Such misalignment can lead to a side-to-side non-uniformity of the film plated onto the wafer, and is particularly problematic in systems in which the wafer is held stationary during processing (e.g., plating a magnetic alloy). This is not as problematic in systems in which the wafer is rotated during processing because any side-to-side non-uniformity can be average out, which greatly reduces the sensitivity of the system misalignment.

Another disadvantage of systems with detached thief electrodes is that they are highly dependent upon the geometry of the chamber to reduce the edge effect even when a thief electrode is used. For example, many existing systems use a shield below the wafer to block a perimeter portion of the wafer from the anodes. Such shields may limit the ability of the thief electrode to adequately control the current density at the perimeter of the wafer. The physical geometry of the chamber may accordingly limit the ability to control the edge effect. Although this is useful in specific plating applications, a plating tool is often used to process different types of wafers with different types of devices. Conventional systems accordingly require different shields for plating onto different wafers in many circumstances. This is problematic because it requires the chamber to be drained, partially disassembled, reassembled with a new shield, and then refilled and recalibrated for processing. This is an expensive and time consuming process to adapt the chamber to plate different types of wafers.

Still another disadvantage of several existing systems with detached thief electrodes is that the thief electrode is located in a lower portion of the chamber. The reaction chambers accordingly need to be drained and partially disassembled to access the thief electrode for cleaning. This is also an expensive and time-consuming process. Therefore, even though thief electrodes have been used in many electroplating apparatus for fabricating semiconductor devices, there is a significant need to improve electroplating chambers to plate materials into high density features with high aspect ratios.

In light of the foregoing, it would be desirable to provide an apparatus and method that ameliorates non-uniformities caused by an offset between the wafer holder and the vessel, reduces particle contamination associated with thief electrodes, and makes it easier to clean and maintain thief electrodes. It would also be desirable to provide electrochemical processing apparatus and methods that can compensate for seed layer or barrier layer resistance, or changes in the bath conductivity, to provide a desired current density across the wafer. There is also a need for a reactor that provides the ability to further control the surface profile of the plated layer across the diameter of the wafer.

SUMMARY

The present invention provides apparatus and methods for electrochemically processing microfeature workpieces that are capable of compensating or otherwise ameliorating many non-uniformities caused by an offset between the wafer holder and the electrodes. The apparatus and methods are further capable of providing better control of the current density across the wafer to compensate for seed layer resistance, barrier layer resistance, and/or bath conductivity. To overcome the problems and challenges of existing thief electrode designs, the present inventors developed an apparatus in which the combination of a supplementary electrode and an associated supplementary virtual electrode mitigate particle contamination, ameliorate non-uniformities caused by wafer-anode misalignment, and provide better control of the edge effect associated with high density features. The supplementary electrode and the supplementary virtual electrode are configured to self-compensate for misalignment between the wafer holder and the anodes. This is accomplished by, at least in part, forming an aperture that defines the virtual supplementary electrode using a portion of the vessel and a portion of the wafer holder. The shape of the aperture is related to the extent and orientation of the offset between the wafer and the anodes so that the aperture is narrower on one side where the wafer holder is closer to the supplementary electrode and wider on the other side where the wafer is further from the supplementary electrode. Another feature that compensates for misalignment between the wafer holder and the electrodes is that the supplementary electrode is close to the supplementary virtual electrode. As a result, even small wafer-anode misalignments (e.g., 0.5-1.0 mm) can produce relatively significant changes in the effect of the supplementary electrode on opposing sides of the wafer. Mechanical alignment to this accuracy is difficult across multiple chambers in a production environment. These features together or separately counteract non-uniformities associated with misalignment between the wafer holder and the vessel.

The apparatus and methods also provide easy cleaning of the thief electrode. This is accomplished by locating the supplementary electrode where it is separate from the wafer holder and above the vessel. The supplementary electrode can accordingly be removed from the chamber without having to disassemble significant portions of the vessel. Moreover, the supplementary electrode is positioned in the exit flow of the processing fluid outside of the processing zone such that particles from the supplementary electrode are entrained in the flow of the processing fluid downstream from the wafer. The particles can then be filtered before the processing fluid is recirculated back into the chamber. As a result, the upper location of the supplementary electrode and its position in the exit flow of the processing fluid provide easy cleaning and mitigate particle contamination.

The apparatus and methods further provide good control of the current density to enhance the uniformity or otherwise provide the desired surface profile on the plated layer. The apparatus accomplishes this, in part, by configuring the supplementary electrode, the supplementary virtual electrode, and the vessel so that the supplementary electrode is not limited by the chamber geometry and has a strong influence on the current density at the perimeter of the wafer. More specifically, the supplementary virtual electrode is located in the processing zone at least proximate to the edge of the wafer and the supplementary electrode is positioned close to the supplementary virtual electrode. Therefore, the current density and plating profiles can be controlled by dynamically changing the current to the supplementary electrode without having to change the physical geometry of the chamber. This is particularly useful when plating different types of wafers in the same apparatus because the different perimeter characteristics of the different wafers can be addressed using the current applied to the supplementary electrode instead of having to change the shields or other components associated with the chamber geometry. The current density may be further controlled by using the configuration of the supplementary electrode and the supplementary virtual electrode in combination with a plurality of anodes and/or virtual anodes in the vessel.

Apparatus in accordance with the invention can have a vessel including a processing zone in which a microfeature wafer is positioned for electrochemical processing. The apparatus further includes at least one counter electrode in the vessel that can operate as an anode or a cathode depending upon the particular plating or electropolishing application. The apparatus further includes a supplementary electrode and a supplementary virtual electrode. The supplementary electrode is configured to operate independently from the counter electrode in the vessel. The supplementary electrode can be a thief electrode biased at the same polarity as the wafer. The supplementary electrode can alternatively be a de-plating electrode for de-plating ring contacts between processing cycles, or the supplementary electrode can further be used as another counter electrode biased opposite the wafer during a portion of a plating cycle or polishing cycle. The supplementary virtual electrode is located in the processing zone, and it is configured to counteract an electric field offset relative to the wafer associated with an offset between the wafer and the counter electrode in the vessel when the wafer is in the processing zone.

The supplementary virtual electrode, more specifically, can have an aperture for shaping an electric field component from the supplementary electrode such that the aperture is formed, at least in part, by a portion of the vessel and a portion of a wafer holder in which the wafer is positioned. In operation, misalignment between the wafer holder and the vessel causes the aperture to have a first width at one side of the wafer holder and a second width different than the first width at an opposing side of the wafer holder. For example, the aperture can have a narrower width at the side of the vessel where the wafer holder is closer to the supplementary electrode compared to an opposing side where the wafer holder is further from the supplementary electrode. The narrower portion of the aperture reduces the effect of the supplementary electrode at that side, while the wider portion of the aperture increases the effect of the supplementary electrode at the opposing side. The different effect of the supplementary electrode on the different sides of the wafer holder self-compensates for the corresponding offset between the wafer holder and the counter electrode. As a result, the apparatus mitigates or ameliorates non-uniformities associated with an offset between the wafer holder and the vessel when the wafer holder holds a wafer in the processing zone.

In summary, the apparatus and methods for electrochemically processing microfeature wafers provide several advantages for electroplating and/or electropolishing processes. First, the configuration of the supplementary electrode and the supplementary virtual electrode self-compensate for offsets between the wafer holder and the counter electrodes. This accordingly enables a thief electrode and/or a de-plating electrode to be located apart from the wafer holder. Second, because the supplementary electrode is not attached the wafer holder, it can be located where it can be easily removed for cleaning and/or where dislodged particles can be swept away from the processing zone. Third, positioning the supplementary virtual electrode in the processing zone at a location relative to the vessel where dielectric shields cannot limit the electric field of the supplementary electrode enables the supplementary electrode to have a strong influence on the current density in the periphery of the wafer. This feature allows the supplementary electrode to effectively control the current density in the periphery of the wafer. As such, it is easier to plate different types of the wafers in the apparatus compared to existing systems in which control of the current density in the periphery of the wafer is limited by the geometry of the vessel.

DETAILED DESCRIPTION

FIGS. 1-8 illustrate several embodiments of apparatus and methods for electrochemically processing microfeature wafers. As used herein, the terms "microfeature wafer" or "wafer" refer to substrates on and/or in which microfeatures are formed. Typical microfeatures include microelectronic circuits or components, thin-film recording heads, data storage elements, microfluidic devices, and other products. Micromachines or micromechanical devices are included within this definition because they are manufactured using much of the same technology that is used in the fabrication of integrated circuits and/or storage elements. The wafers can be semiconductor pieces (e.g., silicon wafers, gallium arsenide wafers, etc.), non-conductive pieces (e.g., ceramic substrates, glass, etc.), or conductive pieces (e.g., doped wafers, conductive substrates, etc.). Also, the term "electrochemical processing" includes electroplating, electro-etching, electropolishing, and/or anodization. Several specific details of the invention are set forth in the following description and in FIGS. 1-8 to provide a thorough understanding of certain embodiments of the invention. One skilled in the art, however, will understand that the present invention may have additional embodiments, or that other embodiments of the invention may be practiced without several of the specific features explained in the following description.

Figure 1:
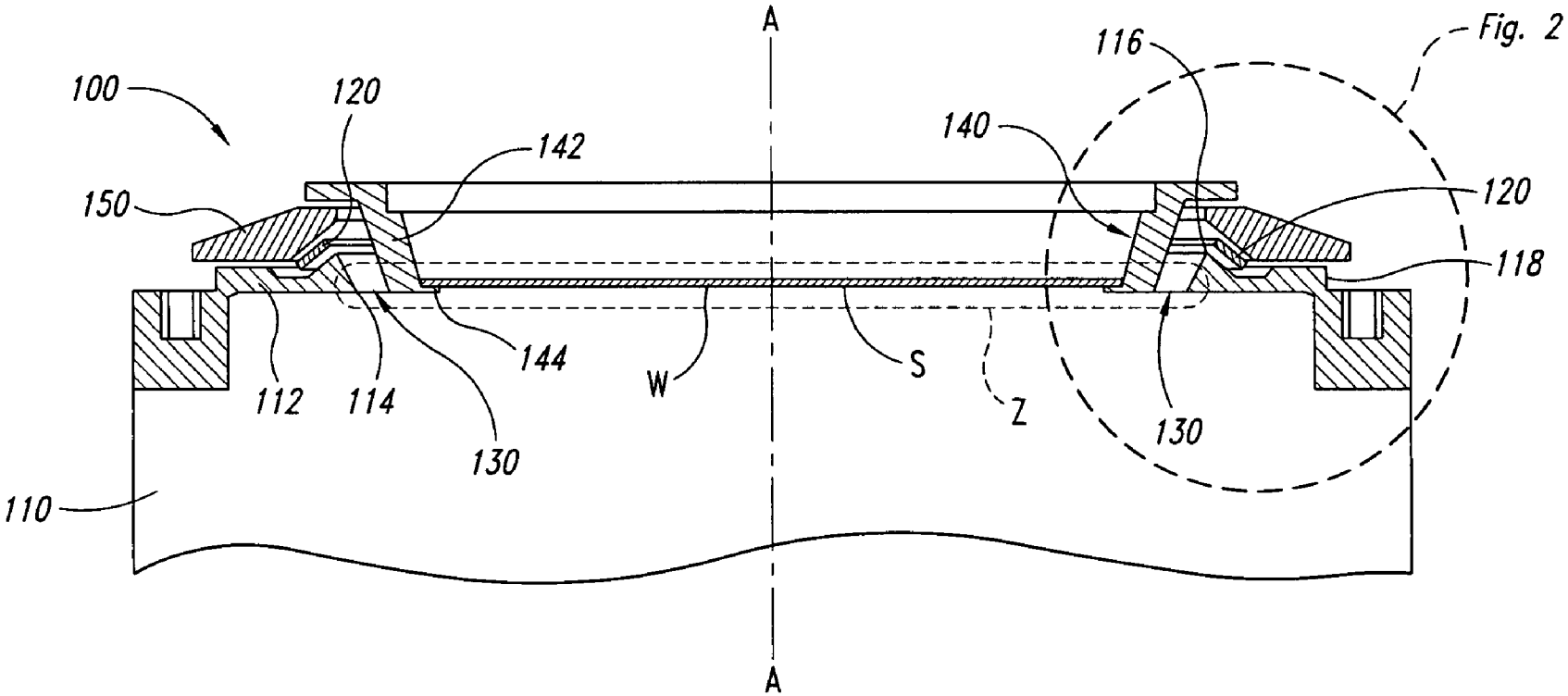
FIG. 1 is a side view of an apparatus in accordance with an embodiment of the invention in which a portion is shown in cross-section and another portion is shown schematically.

FIG. 1 is a side view of an apparatus 100 for electrochemically processing a wafer W. The apparatus 100 includes a vessel 110 having a processing zone Z in which a surface S of the wafer W can be positioned for electrochemical processing. The vessel 110 is configured to contain a flow of processing fluid, and at least one counter electrode (not shown in FIG. 1) is positioned in the vessel 110. The wafer W can be electrically connected to a power supply such that the wafer W is a working electrode that acts as either an anode or cathode, and the counter electrode in the vessel acts as the other of the cathode or anode. The apparatus 100 further includes a supplementary electrode 120 that is configured to operate independently from the counter electrode in the vessel, and a supplementary virtual electrode 130 in, or at least proximate to, the processing zone Z. The supplementary electrode 120 can be a thief electrode that acts through the supplementary virtual electrode 130 to control or otherwise influence the electric field at a perimeter portion of the wafer W. The supplementary electrode 120 and supplementary virtual electrode 130 are configured to compensate for misalignment between the wafer W and the counter electrode in the vessel 110 as explained in more detail below.

Figure 2:
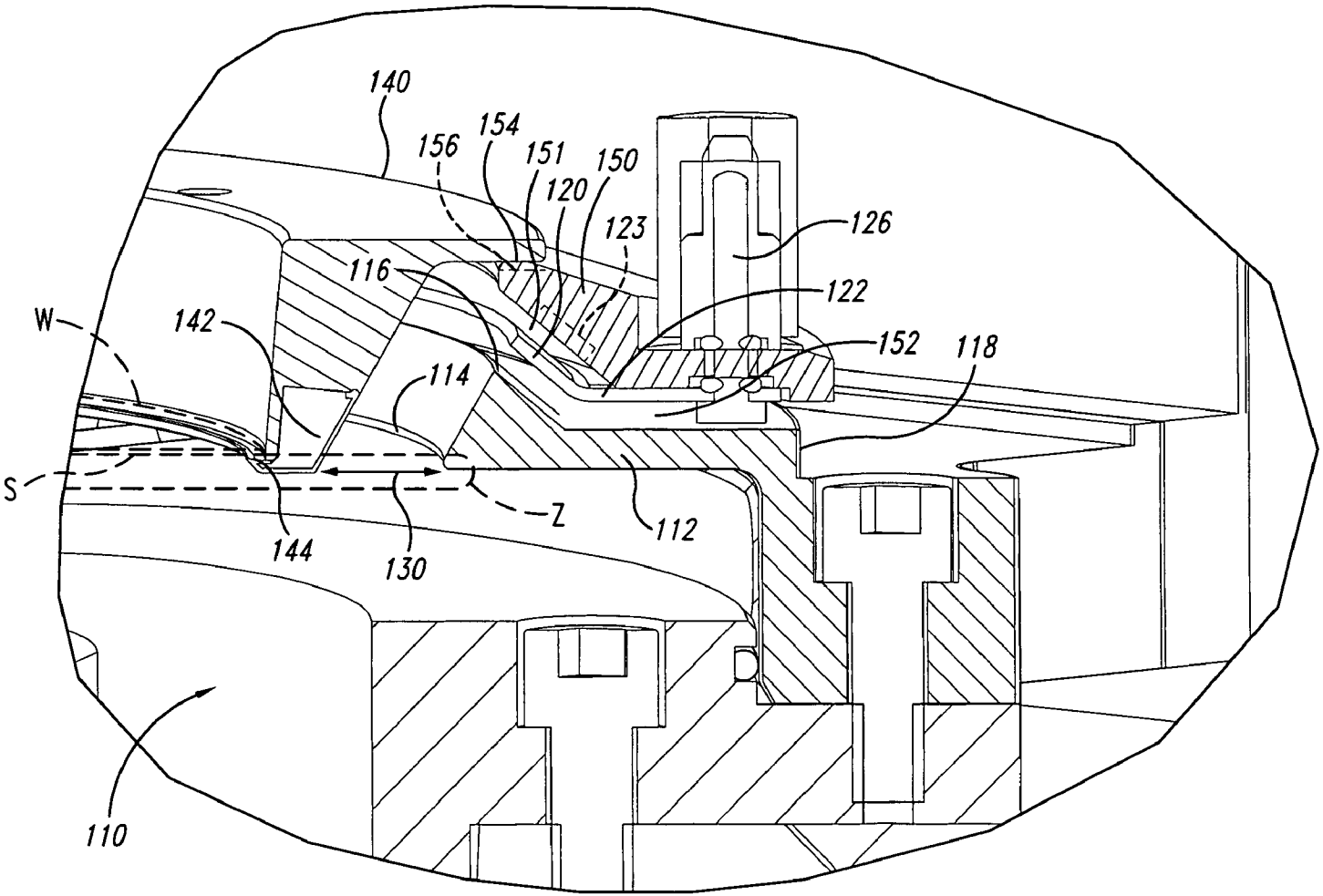
FIG. 2 is an isometric view illustrating a portion of the apparatus of FIG. 1 in greater detail.

FIG. 2 is an isometric view of a portion of the apparatus 100 that shows several features in greater detail. Referring to FIGS. 1 and 2 together, the apparatus 100 can further include a wafer holder 140 having a support 142 configured to hold the wafer W in the processing zone Z. The support 142, more specifically, is configured to hold the surface S of the wafer W face down in a horizontal orientation in contact with a processing fluid flowing upwardly through the processing zone Z. The wafer holder 140 also has at least one electrical contact 144 configured to provide an electrical current to the wafer W. The wafer holder 140, for example, can have a contact configured to contact the backside of the wafer W as shown and described in U.S. Patent Publication No. US2005-0006241A1, which is incorporated herein by reference. The wafer holder 140 can alternatively include a plurality of electrical contacts 144 configured to engage a perimeter portion of the surface S of the wafer W either in lieu of or in addition to a backside contact. Suitable wafer holders 140 with a plurality of electrical contacts 144 are shown and described in U.S. Pat. Nos. 6,080,291; 6,527,925; 6,773,560; and U.S. application Ser. No. 11/170,557, all of which are incorporated herein by reference. The wafer holder 140 may also include a seal at the lower lip of the support configured to seal against a perimeter portion of the surface S of the workpiece W.

As also shown in FIGS. 1 and 2, the vessel 110 can further include a member 112 with an inner edge 114, a rim 116 above the inner edge 114, and a perimeter 118. In the example of the apparatus 100 shown in FIG. 2, the inner edge 114 of the member 112 is positioned in a plane corresponding to a portion of the support 142 such that the supplementary virtual electrode 130 has an aperture defined by the space between the inner edge 114 and the support 142. The aperture of the virtual supplementary electrode 130 can be in a plane that is at least generally parallel to a processing plane of the wafer W and located at a lower portion of the wafer holder 140. The shape of the aperture of the supplementary virtual electrode 130 is accordingly a function of the space between the support 142 and the inner edge 114 such that the aperture will be narrower on one side of the wafer holder 140 and wider on an opposing side when the wafer holder 140 and the vessel 110 are misaligned with each other relative to an axis A-A (FIG. 1). The aperture of the supplementary virtual electrode 130, for example, can have a first width at one side of the wafer holder 140 and a second width different than the first width at another side of the wafer holder 140 corresponding to the degree of misalignment between the wafer holder 140 and the vessel 110. Therefore, as explained in more detail below, the supplementary virtual electrode 130 self-compensates for any misalignment between the wafer holder 140 and the vessel 110 to counteract a corresponding offset between the wafer W and a counter electrode in the vessel 110.

The apparatus 100 can further include a mount 150 above the member 112. Referring to FIG. 2, the mount 150 and the member 112 form a compartment 151 having a first flow outlet 152 through which a portion of the processing fluid can exit the processing zone and flow over the perimeter 118 of the vessel 110. The compartment 151 is also configured to contain the supplementary electrode 120 at a location above the processing zone Z. In the example illustrated in FIG. 2, the supplementary electrode 120 is located above the member 112 at a radial position between the inner edge 114 and the perimeter 118. The supplementary electrode 120 can be attached to the mount 150 by a number of posts or tabs 122 to suspend the supplementary electrode 120 in the compartment 151 between the mount 150 and the member 112. In an alternative embodiment, the supplementary electrode can be embedded within a recess 123 (shown in broken lines) in the underside of the mount 150. It is generally preferable to have the supplementary electrode 120 suspended in the compartment 151 to avoid chemicals from collecting in such a recess, and also to provide additional surface area for the supplementary electrode 120 to contact the processing fluid. The supplementary electrode 120 can be coupled to a power supply via a connector 126.

The mount 150 further includes a brim 154 and a plurality of optional channels 156 (shown in broken lines) through which the processing fluid can flow between the mount 150 and the wafer holder 140. The channels 156 accordingly provide a second flow outlet for the processing fluid. The flow of processing fluid through the channels 156 wets the brim 154 and the upwardly facing inclined surface of the mount 150 to avoid crystal formation on the top of the mount 150 that can occur when the processing fluid dries. As explained in more detail below, this feature enables the wafer holder 140 to bottom out against the brim 154 without contacting crystal formations on top of the mount 150 to avoid skewing the wafer holder at an improper angle.

Figure 3:
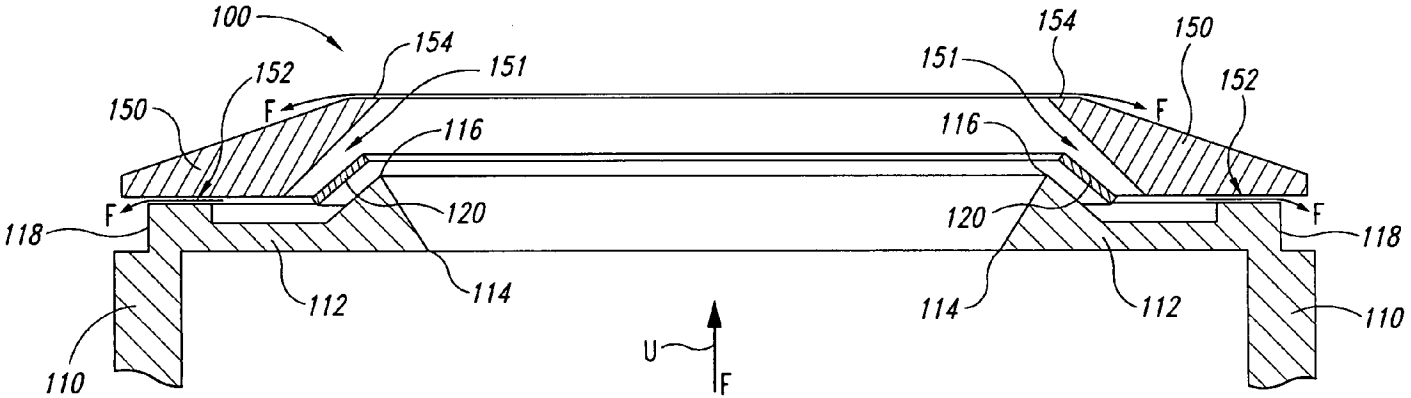
FIG. 3 is a cross-sectional view illustrating one aspect of operating an apparatus in accordance with an embodiment of the invention.
Figure 4:
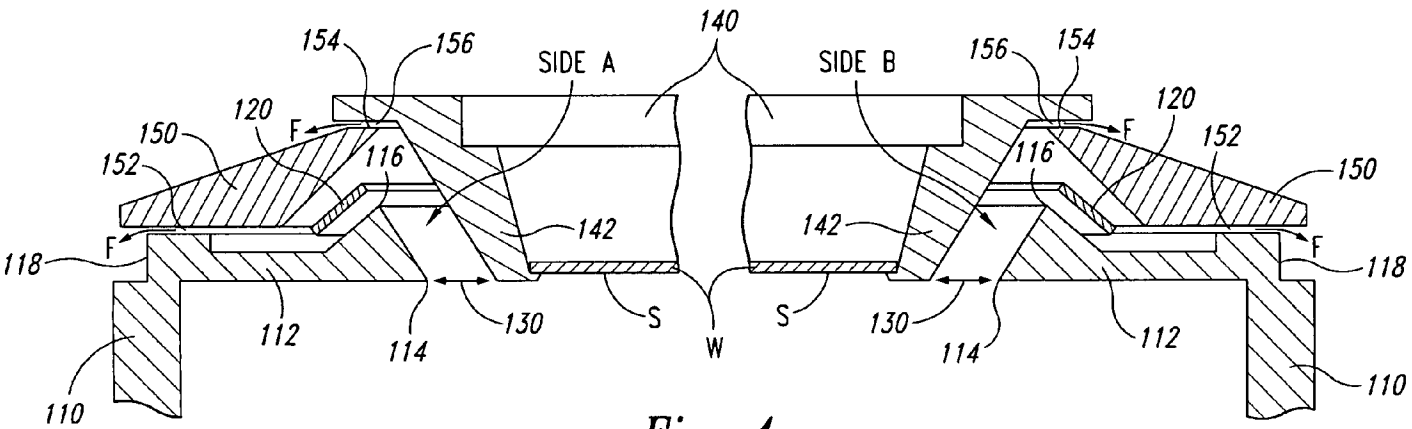
FIG. 4 is a cross-sectional view illustrating another aspect of operating the apparatus of FIG. 3.

FIGS. 3 and 4 are cross-sectional views illustrating the operation and advantages of the apparatus 100. FIG. 3, more specifically, illustrates the apparatus 100 during a state without a wafer in position for processing. The processing fluid F flows upwardly U through an opening defined by the member 112. The upper level of the processing fluid F is defined by the brim 154 of the mount 150; the brim 154 accordingly acts as a weir, and the fluid height of the processing fluid F is generally slightly above the height of the brim 154. The processing fluid F flows over the top of the brim 154 and the upwardly facing inclined surface of the mount 150 between processing cycles to avoid crystal formations on the top of the mount 150. This feature mitigates misalignment of the wafer holder during processing that can be caused by crystal formations on top of the brim 154. A portion of the processing fluid F also flows through the compartment 151 and through the outlet 152. This portion of processing fluid F flows outwardly past the perimeter 118 of the vessel 110 to carry away particles that are dislodged from the supplementary electrode 120. The processing fluid F is then filtered to remove particles, bubbles and other contaminants before it is recycled through the vessel 110.

FIG. 4 illustrates the apparatus 100 during a processing cycle after the wafer holder 140 has positioned the wafer W in processing plane in the processing zone Z. The supplementary electrode 120 is activated during the processing cycle to provide an electric field component that acts through the supplementary virtual electrode 130 for controlling the current density in the perimeter region of the wafer W. In the example shown in FIG. 4, the central axis of the wafer holder 140 is misaligned relative to the vessel 110 such that one side of the wafer holder 140 is closer to the member 112 than the opposing side. When this occurs, the width of the supplementary virtual electrode 130 is narrower on the side at which the wafer holder 140 is closer to the supplementary electrode 120 (side A), and wider on the side where the wafer holder 140 is further from the supplementary electrode 120 (side B). The narrow portion of the supplementary virtual electrode 130 restricts the electric field component of the supplementary electrode 120 in that region of the wafer holder 140 to reduce the influence of the supplementary electrode 120 in a corresponding region of the wafer W. Conversely, the wide portion of the supplementary virtual electrode 130 increases the electric field component of the supplementary electrode 120 in the region where the wafer W is further away from the supplementary electrode 120. The supplementary virtual electrode 130, therefore, self-compensates for misalignment between the wafer holder 140 and the vessel 110 because the shape of the aperture that defines the supplementary virtual electrode 130 is defined, at least in part, by the relative position between the wafer holder 140 and the corresponding structure of the vessel 110. The apparatus 100 accordingly provides a robust system that is less sensitive to misalignment between the wafer holder 140 and the vessel 110.

Another feature of the apparatus 100 is that the supplementary electrode 120 can be located very close to the supplementary virtual electrode 130, and the supplementary virtual electrode 130 is located close to the perimeter of the wafer W. The supplementary electrode 120 is located above the member 112 and proximate to the wafer holder 140 so that the distance to the supplementary virtual electrode 130 is short compared to the location of thief electrodes in prior art devices. This arrangement causes only a small voltage drop between the supplementary electrode 120 and the supplementary virtual electrode 130. The resistance between the supplementary electrode 120 and the supplementary virtual electrode 130 is accordingly a function of the distance between these components. As a result, local resistance changes caused by a misalignment between the wafer holder 140 and the vessel 110 can constitute a significant percentage of the resistance value between a wafer W that is perfectly aligned with the supplementary electrode 120. The different widths of the different regions of the supplementary virtual electrode 130, therefore, will have a significant influence on the electric field at the perimeter of the wafer W to counteract non-uniformities caused by the misalignment. The close proximity of the supplementary virtual electrode 130 to the perimeter of the wafer W further enhances the ability of the system to counteract even small misalignments between the wafer holder 140 and the vessel 110.

The apparatus 100 is particularly useful for plating materials onto wafers that are not rotated during the plating cycle. For example, magnetic media are fabricated by holding the wafer W stationary during a plating cycle to maintain the desired orientation between the magnetic field and the wafer W. In these applications any misalignment between the wafer holder and the vessel will cause a corresponding offset in the electric field relative to the surface S of the wafer W. The apparatus 100 with the supplementary electrode 120 and the supplementary virtual electrode 130 counteracts the non-uniformities caused by a misalignment between the wafer holder 140 and the vessel 110 to enable the supplementary electrode 120 to be spaced apart from the wafer holder and operate as a thief electrode in such applications.

Another advantage of the apparatus 100 is that it reduces the problems associated with particle contamination and makes it easier to maintain the supplementary electrode 120. More specifically, because the supplementary electrode 120 is spaced apart from the wafer W and resides in the exit flow of the processing fluid F, particles dislodged from the supplementary electrode 120 are carried away from the wafer W and out of the vessel 110. Such particles can then be filtered out of the processing fluid F before it is recycled to the vessel 110. Moreover, because the supplementary electrode 120 is positioned above the vessel 110, it is easily removed for maintenance by detaching the mount 150 from the vessel 110 without having to drain the vessel below the member 112 and/or disassemble the vessel 110. This feature will greatly enhance the ability to clean the supplementary electrode 120 without incurring significant downtime. As such, the apparatus 100 is also particularly applicable and advantageous in applications in which the supplementary electrode 120 is a thief electrode that is subject to frequent cleaning.

The apparatus 100 is also advantageous because it enhances the ability to control the current density at the perimeter of the wafer without changing the geometry of the chamber. As explained above, many existing plating chambers without thief electrodes use mechanical shields in the vessel to limit the current density at the edge of the wafer. Although these systems are useful, it is cumbersome to change such shields to adapt a chamber to process a different type of wafer. Moreover, such shields may limit the ability to provide the desired current to the perimeter of the wafer W at certain times of the plating cycle. The apparatus 100 improves the control of the current density at the perimeter of the wafer W because the supplementary virtual electrode 130 is located in, or at least proximate to, the processing zone Z. For example, when the supplementary virtual electrode 130 is located above any shields in the reactor and/or a virtual anode(s) in the vessel, the supplementary virtual electrode 130 has a strong influence on the current density at the perimeter of the wafer W. This configuration prevents the geometry of the vessel 110 from limiting the electric field component of the supplementary electrode 120. The current density in the perimeter of the wafer W, therefore, can be more fully controlled during a plating cycle by changing the current through the supplementary electrode 120 to compensate for electrical properties at the surface of the wafer W and in the processing fluid without being limited by the geometry of the vessel. As a result, the apparatus 100 can be adapted for plating different types of wafers and/or control of the current density during plating cycles by merely controlling the current through the supplementary electrode 120 without having to change the physical geometry of the chamber. This feature will greatly enhance the efficacy of plating onto thin seed layers or directly onto barrier layers where it is necessary to overcome the significant drop in current density across the wafer during the initial stages of the plating cycle. This feature is similarly important to applications with a high density of features for analogous reasons.

Figure 5:
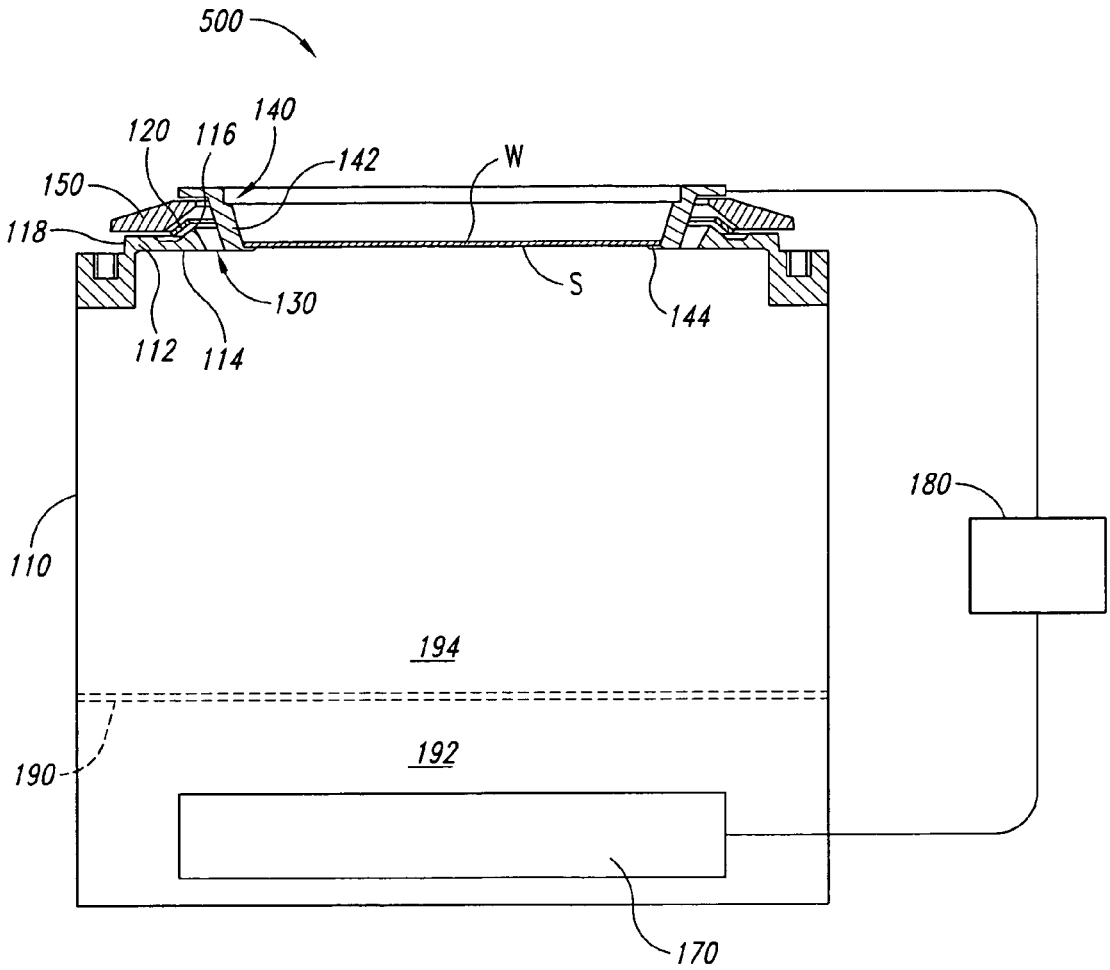
FIG. 5 is a side view of an apparatus in accordance with the invention in which a portion of the apparatus is shown in cross-section and another portion is shown schematically.

FIG. 5 is a side view of an apparatus 500 in accordance with another embodiment of the invention in which some features are shown in cross section and other features are shown schematically. Like reference numbers refer to like components throughout FIGS. 1-5. The apparatus 500 includes a counter electrode 170 in the vessel 110 and a power supply 180 operatively coupled to the contacts 144 and the counter electrode 170. In this embodiment, the counter electrode 170 is a single electrode in the vessel 110. The vessel can contain a single processing fluid that flows upwardly to the wafer W, or the apparatus 500 can further include an ion exchange membrane 190 in the vessel 110, a first cell 192 on one side of the ion-membrane 190 for an anolyte or a catholyte, and a second cell 194 on the other side of the ion-exchange membrane 190 for the other of the catholyte or the anolyte. Suitable configurations for the ion-exchange membrane 190, the first cell 192, and the second cell 194 are described and shown in U.S. Patent Publication Nos. US2003-0127337A1; US2005-0121317A1; US2005-0121326A1; and US2006-0144699A1, which are herein incorporated by reference. The apparatus 500 is accordingly an electroplating or electropolishing system that can operate in the same manner as the apparatus 100 described above with reference to FIGS. 1-4.

Figure 6:
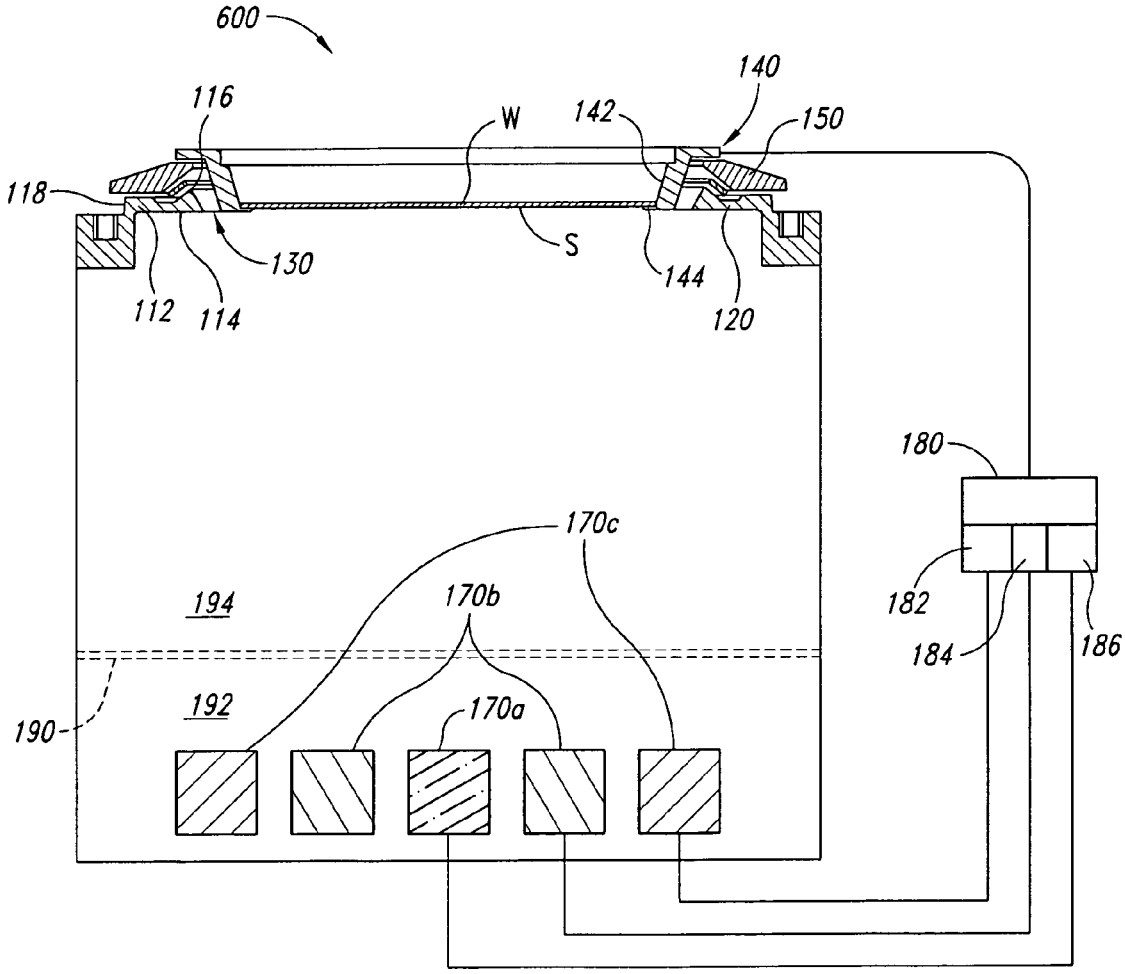
FIG. 6 is a side view of an apparatus in accordance with another embodiment of the invention in which a portion of the apparatus is shown in cross-section and another portion is shown schematically.

FIG. 6 is a side view of an apparatus 600 in accordance with still another embodiment of the invention in which some features are shown in cross-section and other features are shown schematically. Like reference numbers refer to like components throughout FIGS. 1-6. The apparatus 600 is similar to the apparatus 500 described above with reference to FIG. 5, but the apparatus 600 includes a plurality of independently operable counter electrodes 170*a-c* that are electrically coupled to a plurality of independent power sources 182, 184 and 186, respectively. In operation, the counter electrodes 170*a-c* can establish an electric field within the apparatus 600 for plating material onto the wafer W or removing material from the wafer W. Suitable multiple-electrode apparatus and methods for operating such apparatus are disclosed in U.S. Patent Publication Nos. US2003-0062258A1; US2002-0139678A1; US2003-0038035A1; US2005-0034809A1; US2005-0050767A1; and US2005-0087439A1 and U.S. Pat. Nos. 6,569,297; 6,660,137; 6,916,412; 7,020,537; and 7,160,421, all of which are incorporated herein by reference. The apparatus 600 is accordingly an electroplating or electropolishing system that can operate in the same manner as the apparatus 100 and 500 described above with reference to FIGS. 1-5.

The apparatus 600 is particularly useful for controlling the current density to compensate for variations in the bath conductivity, seed layer conductivity, and different thickness profile requirements for various wafers. During the initial part of a plating cycle for depositing copper onto a very thin seed layer or directly onto a barrier layer, the perimeter portion of the wafer has a much higher current density than the center portion because of the resistance of the seed layer or barrier layer. However, after enough copper has plated onto the wafer, the current density is much more uniform across the wafer. The apparatus 600 can compensate for such variations in the current density during the plating cycle by dynamically varying the current applied to each of the counter electrodes 170*a-c* and the supplementary electrode 120. In one specific embodiment of using the apparatus 600, the supplementary electrode 120 is a cathodic thief electrode, and the counter electrodes 170*a-c* are anodes that operate at different current levels. As material is plated onto the wafer, the current to the thief may be reduced and the current to each of the counter electrodes 170*a-c* may be varied to create the desired plating profile on the workpiece. Other aspects of using the apparatus 600 can include varying the currents to the counter electrodes 170*a-c* and the supplementary electrode 120 to compensate for changes in the bath conductivity over time as well as providing good control to plate different thickness profiles and different types of wafers.

Figure 7:
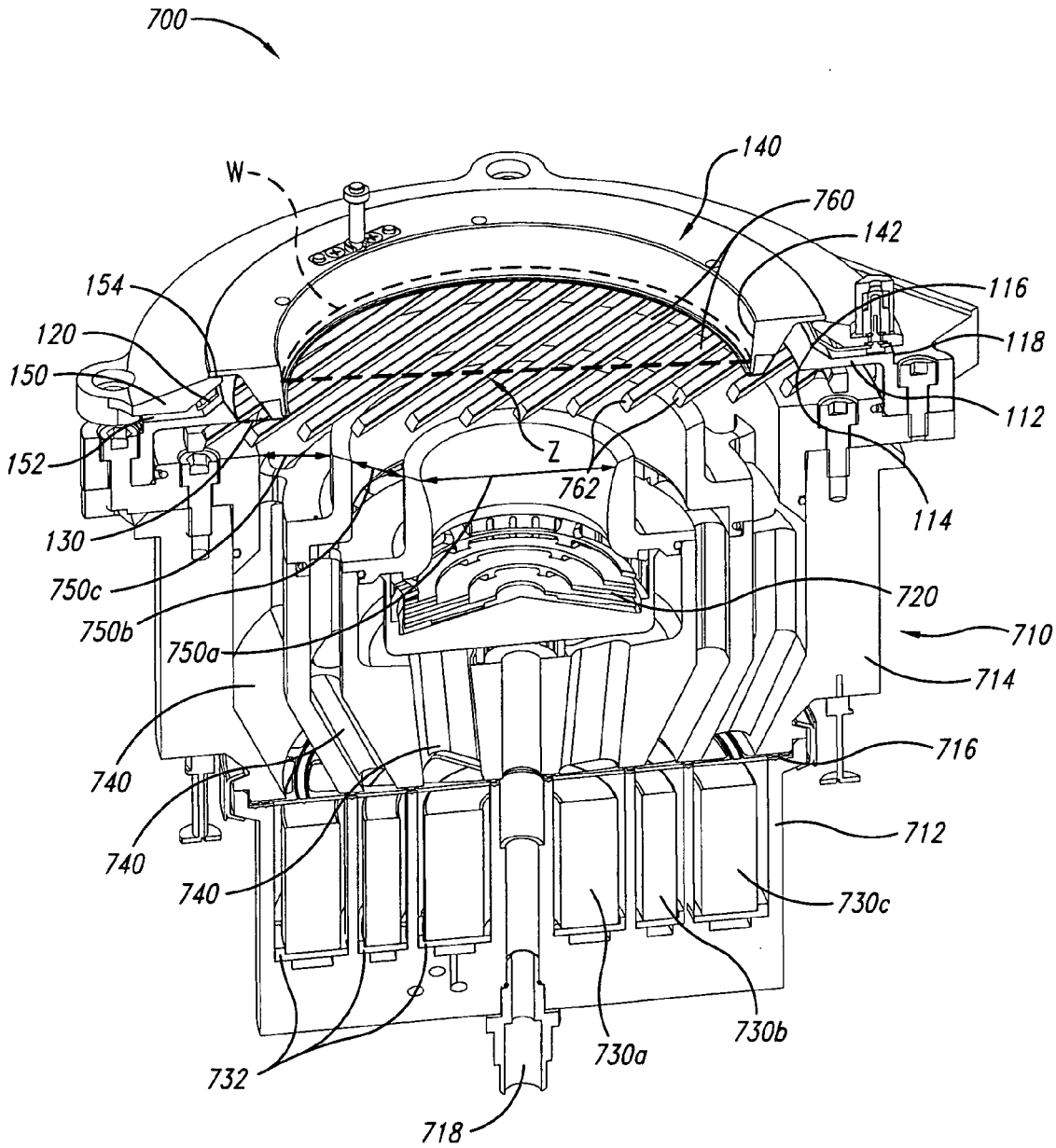
FIG. 7 is a cross-sectional isometric view of an apparatus in accordance with a specific embodiment of the invention.
Figure 8:
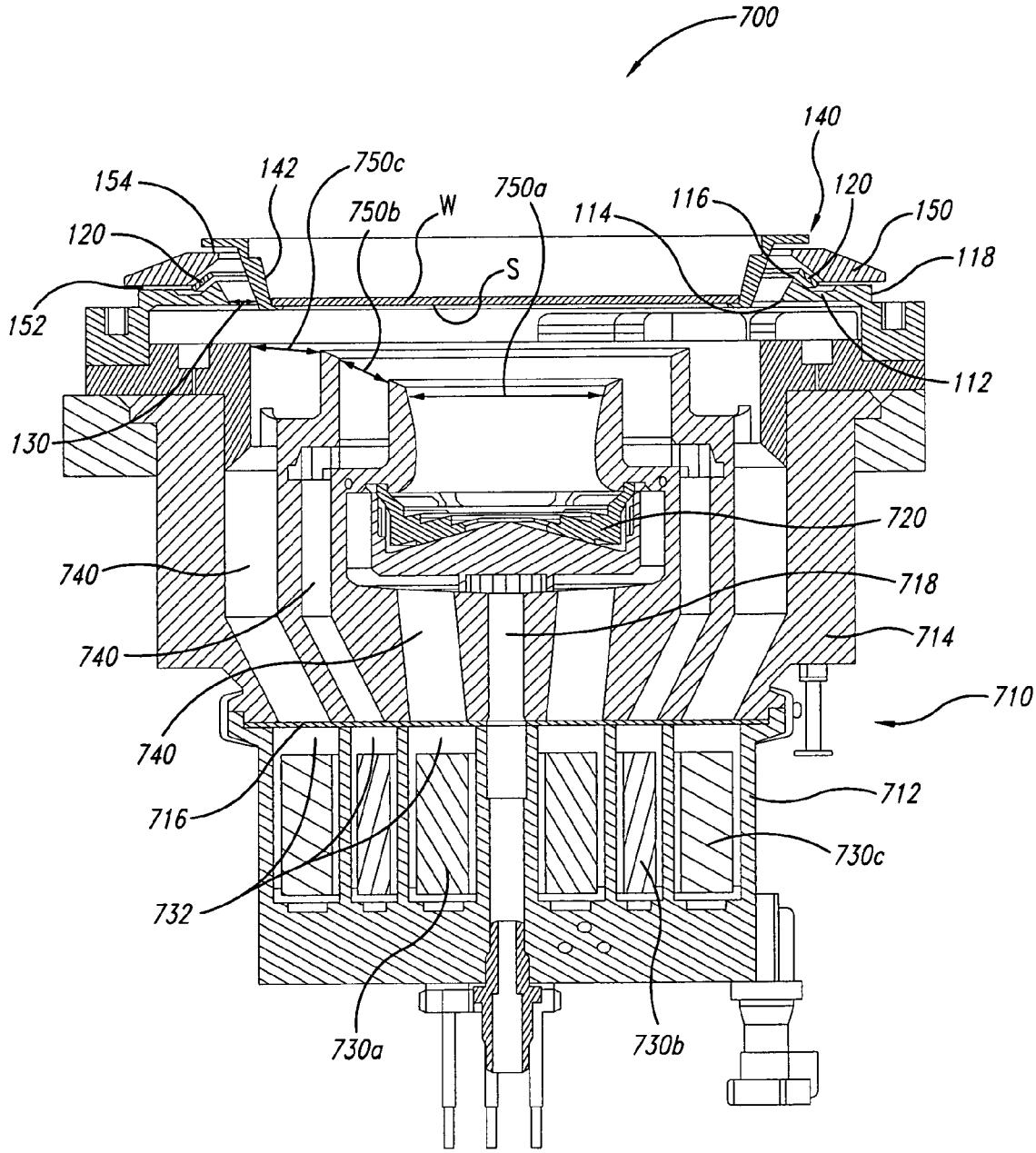
FIG. 8 is a cross-sectional view of the specific embodiment shown in FIG. 7.

FIG. 7 is an isometric view of an apparatus 700 in accordance with a particular embodiment of the invention, and FIG. 8 is a cross-sectional view of the apparatus 700. Like reference numbers refer to like components throughout FIGS. 1-8. As such, the apparatus 700 includes the supplementary electrode 120, supplementary virtual electrode 130, wafer holder 140, and mount 150. For a 200 mm wafer W, a representative width of the supplementary virtual electrode 130 is about 13 mm. The apparatus 700 further includes a vessel 710 having a lower portion 712, an upper portion 714 with a horizontal processing zone Z (FIG. 7) at which the wafer W is processed, and an interface 716 between the lower portion 712 and the upper portion 714. The interface 716 can be a gasket, filter and/or an ion-exchange membrane.

The apparatus 700 further includes one or more counter electrodes 730, such as the three that are shown and identified as first, second and third electrodes 730*a*, 730*b* and 730*c*, respectively. Accordingly, the lower portion 712 is also an electrode support having annular compartments 732 with upwardly extending walls that terminate near the interface 716. Each electrode 730*a-c* is positioned in a corresponding annular compartment 732. The upper portion 714 has channels 740 corresponding to the compartments 732, and each channel 740 has at least one upwardly extending dielectric wall to define virtual counter electrodes 750*a-c* corresponding to the electrodes 730*a-c*, respectively. The electrodes 730*a*-730*c*, each of which can be independently controlled, can accordingly operate via the corresponding virtual counter electrodes 750*a-c* at locations below the supplementary virtual electrode 130.

In operation, the processing fluid enters the vessel 710 through a fluid inlet 718 that passes through a center opening in the lower portion 712 and an opening in the center of the innermost anode 730*a*. The processing fluid proceeds to a flow control assembly 720 that directs the processing fluid generally radially inward after which the fluid turns upwardly and flows toward the processing zone Z. A portion of the processing fluid flows through an opening defined by the inner edge 114 and over the rim 116 and the brim 154 as described above with respect to FIGS. 3 and 4. Another portion of the processing fluid flows downwardly through the channels 740, into the electrode compartments 732, and through an exit outlet in the lower portion 712.

The apparatus 700 can further include an agitator 760 between the virtual anodes 750*a-c* and the wafer holder 140. The agitator 760 includes a plurality of agitator elements 762 that can be elongated bars arranged generally parallel to each other. The agitator 760 reciprocates in a direction generally transverse to the longitudinal dimension of the agitator elements 762 to agitate the processing fluid in the processing zone Z. Suitable agitators are disclosed in U.S. Patent Publication Nos. US2005-0006241A1; US2005-0000817A1, and US2004-0245094A1; and pending U.S. application Ser. No. 11/603,940 filed Nov. 22, 2006, all of which are incorporated herein by reference. The apparatus 700 is particularly useful for applications that include an agitator and hold the wafer stationary during processing because the dielectric walls that define the virtual counter electrode 750*a-c* are located a sufficient distance below the wafer W to provide room for the agitator so that the agitator 760 does not greatly disturb the axis-symmetric electric field. Also, locating the virtual thief opening at the processing zone Z above the agitator 760 minimizes the disruption that the agitator may have on the thief electric field contribution. Therefore, the apparatus 700 having a virtual thief opening proximate to the workpiece holder 140 and above the agitator 760 in combination with a multiple anode system having virtual anodes located sufficiently below the wafer holder 140 to provide room for the agitator achieves superior control of the plating performance.

Another feature of the apparatus 700 is that the third virtual anode opening 750*c* has an outer diameter that is greater than the outer diameter of the seal against the perimeter of the wafer W. This feature allows the wafer holder 140 to be misaligned relative to the vessel 710 without having the perimeter of either side of the wafer W shielded by the outer diameter of the third virtual electrode 750*c*. As a result, the apparatus 700 minimizes the sensitivity to misalignment between the wafer holder 140 and the vessel 710 as well as radio manufacturing tolerances.

In an alternative embodiment, the vessel 710 can be configured to contain an anolyte separately from a catholyte. For example, the lower portion 712 can be a first cell and the upper portion 714 can be a second cell. The lower portion 712 can be one of an anolyte or catholyte cell through which a flow of a first processing fluid passes, and the upper portion 714 can be the other of a catholyte or anolyte cell through which a flow of a second processing fluid passes. The interface 716 in this type of reactor is an ion-exchange membrane that separates the first processing fluid in the lower portion 712 and from the second processing fluid in the upper portion 714. The ion-exchange membrane is configured to prevent the first and second fluids from passing between the lower portion 712 and the upper portion 714, but to allow the desired ion transfer across the membrane to carry out the electrochemical process. Suitable vessels with multiple-electrodes and/or ion-exchange membranes are described and shown in U.S. Patent Publication Nos. US2005-0121317A1; US2005-0121326A1; US2006-0144699A1; and US2005-0087439A1, all of which were previously incorporated herein by reference.

Figure 9:
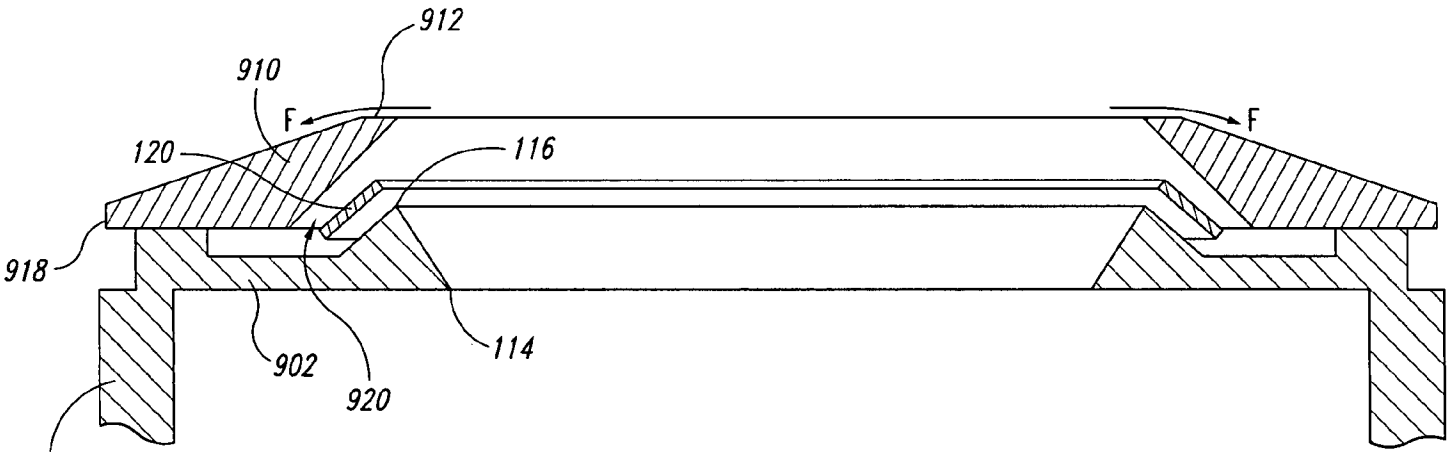
FIG. 9 is a cross-sectional view of another embodiment of the invention.

FIG. 9 is a cross-sectional view illustrating an apparatus in accordance with another embodiment of the invention. Like reference numbers refer to like components in FIGS. 1-9. In this embodiment, the vessel 110 includes a member 902 that is similar to the member 112 described above with reference to FIGS. 1-4. The member 902 includes the inner edge 114 and the rim 116, but there is not an outlet at member 902. The apparatus also includes a mount 910 that is attached to, or integral with, the vessel 110 to form a compartment 920 in which the supplementary electrode 120 is positioned. The mount 910 has a brim that defines a single weir over which the processing fluid flows outwardly to the perimeter 918 of the vessel 110.

Figure 10:
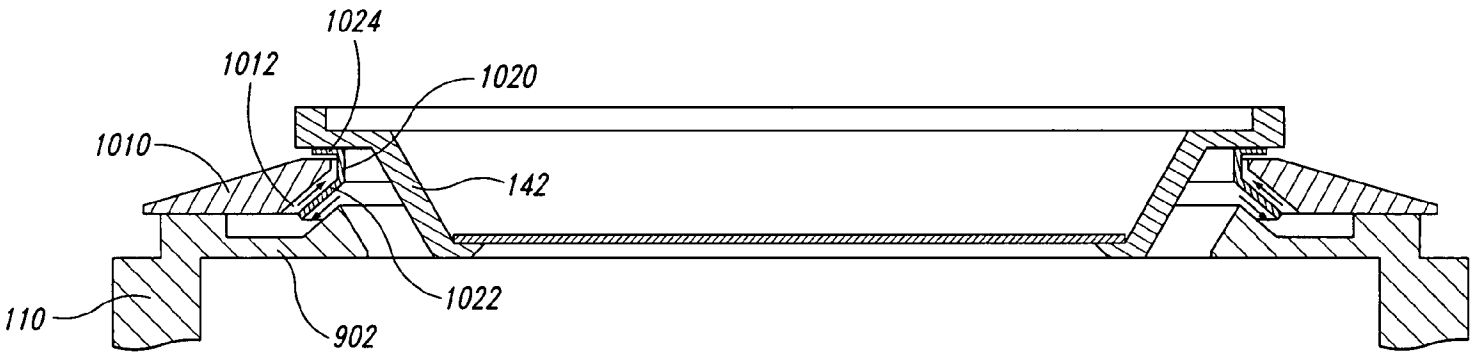
FIG. 10 is a cross-sectional view of another embodiment of the invention.

FIG. 10 is a cross-sectional view of a portion of an apparatus in accordance with another embodiment of the invention. Like reference numbers refer to like embodiments in FIGS. 1-10. In this embodiment, the vessel 110 includes the member 902, a mount 1010 above the member that defines a compartment 1012, and a supplementary electrode 1020 having a first portion 1022 in the compartment 1012 and a second portion 1024 outside of the compartment 1012. The first portion 1024 defines a flow channel such that the processing fluid flows along the supplementary electrode 1020. More specifically, the processing fluid can flow outwardly along an underside of the first portion 1022 and then inwardly relative to a central axis of the vessel 110 along an upper side of the first portion 1022. The supplementary electrode 1020 can be attached to the mount 1010 using tabs in the compartment and/or the second portion 1024 can be attached to the brim of the mount 1010. The apparatus illustrated in FIG. 10 eliminates the need to balance the flow between two exits as shown in the apparatus 100 illustrated in FIGS. 1-4. The apparatus illustrated in FIG. 10 may also provide satisfactory flow over the brim at a lower total overflow rate, and it may be less susceptible to ingesting bubbles as an agitator oscillates back and forth because it creates a longer path from the brim openings to the wafer W.

From the foregoing, it will be appreciated that specific embodiments of the invention have been described herein for purposes of illustration, but that various modifications may be made without deviating from the spirit and scope of the invention. For example, the member 112 may have different configurations, or the virtual supplementary electrode 130 may have a different location and/or orientation (e.g., inclined relative to the plane of the wafer or shaped by a different portion of the vessel). Additionally, the supplementary electrode 120 can be a de-plating electrode either in addition to or in lieu of being a thief electrode. Such de-plating electrodes can be used to de-plate material from the contacts of the wafer holder. In still additional embodiments, the supplementary electrode 120 can operate as another counter electrode. One example of this may be forward-reverse pulse plating. During the forward-current portion of the waveform, the supplementary electrode can function as a thief or cathode, while the counter electrodes in the vessel function as anodes. During the reverse-portion of the current waveform, the supplementary electrode can function as an anode whereas the counter electrodes in the vessel function as cathodes. In still other embodiments, the supplementary electrode can function as an anode while the counter electrodes in the vessel also function as additional anodes. In still additional embodiments, the shape of the inner edge and/or the shape of the outer surface of the wafer holder can be configured to shape the virtual supplementary electrode. The inner edge of the vessel and/or the outer edge of the wafer holder can be changed dynamically during or between processing cycles, or the shape of these features can be changed by replacing circular components with different shapes (e.g., ovals, ellipses, eccentric shapes, etc.).Certain features of the invention described in the context of the foregoing particular embodiments may be combined or eliminated in other embodiments. Accordingly, the invention is not limited except as by the appended claims.

We claim:

1. An apparatus for electrochemically processing a microfeature wafer, comprising:

a vessel having a processing zone;

a wafer holder associated with the vessel and adapted to hold a wafer in the processing zone of the vessel for electrochemical processing;

at least one counter electrode in the vessel;

a supplementary electrode configured to operate independently from the counter electrode; and a supplementary virtual electrode below the supplementary electrode, wherein the supplementary virtual electrode is configured to counteract an electric field offset relative to the wafer associated with an offset between the wafer and the counter electrode when the wafer is in the processing zone, and wherein the supplementary electrode comprises an inclined annular ring oriented at a non-zero angle relative to the supplementary virtual electrode.

2. The apparatus of claim 1 wherein the supplementary virtual electrode is located between the wafer holder and an annular member substantially surrounding the wafer holder.

3. The apparatus of claim 1 wherein the supplementary virtual electrode is oriented in a plane substantially parallel to a plane of a wafer held in the wafer holder.

4. The apparatus of claim 1 wherein the supplementary virtual electrode has an aperture for shaping an electric field component from the supplementary electrode, and wherein the aperture is formed, at least in part, by an inner edge of an annular member around the wafer holder.

5. The apparatus of claim 1, further comprising a plurality of counter electrodes, and wherein the counter electrodes are configured to be operated independently from each other and the supplementary electrode.

6. The apparatus of claim 5, further comprising a plurality of virtual counter electrodes corresponding to the counter electrodes, wherein the virtual counter electrodes have apertures located below the supplementary virtual electrode.

7. The apparatus of claim 1 with the wafer holder having a wafer support configured to hold a microfeature wafer and an electrical contact, and wherein the supplementary virtual electrode has an aperture defined, at least in part, by the vessel and the wafer holder.

8. The apparatus of claim 1 wherein:

the vessel includes a member having an inner edge, a rim above the inner edge, and a perimeter; and the wafer holder has a wafer support configured to hold a microfeature wafer and an electrical contact configured to contact a plating surface of the wafer, and wherein the supplementary virtual electrode has an aperture defined, at least in part, by the inner edge of the member and the wafer support of the wafer holder.

9. The apparatus of claim 8 wherein the aperture of the supplementary virtual electrode has an outer diameter defined by the inner edge of the member and an inner diameter defined by an outer diameter of a portion of the wafer support.

10. The apparatus of claim 9 wherein the aperture of the supplementary virtual electrode has a first width at one side of the wafer holder and a second width different than the first width at an opposing side of the wafer holder.

11. The apparatus of claim 1 wherein the supplementary virtual electrode has an aperture with a first width at one side of the processing zone and a second width different than the first width at an opposing side of the processing zone when a central axis of the wafer is offset relative to a central axis of an electric field of the counter electrode.

12. An apparatus for electrochemically processing a microfeature wafer, comprising:

a vessel having a processing zone through which a processing fluid can flow upward, a rim over which the processing fluid can flow out of the processing zone, and a perimeter radially outward from the rim over which the processing fluid can flow downwardly;

a wafer holder having a support configured to hold a microfeature wafer in the processing zone and at least one electrical contact configured to provide an electrical current to the wafer;

at least one counter electrode in the vessel;

a supplementary electrode spaced apart from the wafer holder; and a supplementary virtual electrode having an aperture configured to shape an electric field component from the supplementary electrode, wherein the aperture is shaped, at least in part, by alignment between the wafer holder and the vessel to counteract non-uniformities associated with an offset between the wafer holder and the vessel when the wafer holder holds a wafer in the processing zone and wherein the supplementary electrode comprises an inclined annular ring oriented at a non-zero angle relative to the supplementary virtual electrode.

13. The apparatus of claim 12 wherein the supplementary virtual electrode is located between the wafer holder and an annular member substantially surrounding the wafer holder.

14. The apparatus of claim 12 wherein the aperture of the supplementary virtual electrode has an outer diameter defined by a portion of the vessel and an inner diameter defined by an outer diameter of a portion of the support of the wafer holder.

15. The apparatus of claim 14 wherein the aperture of the supplementary virtual electrode has a first width at one side of the wafer holder and a second width different than the first width at an opposing side of the wafer holder.

16. The apparatus of claim 12 wherein the supplementary virtual electrode has an aperture with a first width at one side of the processing zone and a second width different than the first width at an opposing side of the processing zone when a central axis of the wafer is offset relative to a central axis of an electric field of the counter electrode.

17. An apparatus for electrochemically processing a microfeature wafer, comprising:

a vessel configured to direct a flow of processing fluid upward, wherein the vessel includes a processing zone through which the upward flow of processing fluid can pass;

a wafer holder having a wafer support configured to hold a microfeature wafer at the processing zone in a position transverse to the upward flow of processing fluid and at least one electrical contact configured to contact a plating surface of the wafer;

at least one counter electrode in the vessel;

a stationary supplementary electrode; and a supplementary virtual electrode associated with the supplementary electrode, wherein the supplementary virtual electrode has an aperture with an outer edge defined at least in part by the vessel and an inner edge defined at least in part by the wafer holder when the wafer holder holds a wafer in the processing zone and wherein the supplementary electrode comprises an inclined annular ring oriented at a non-zero angle relative to the supplementary virtual electrode.

18. The apparatus of claim 17 wherein the supplementary virtual electrode is located between the wafer holder and an annular member substantially surrounding the wafer holder.

19. The apparatus of claim 17, further comprising a plurality of counter electrodes, and wherein the counter electrodes are configured to be operated independently from each other and the supplementary electrode.

20. The apparatus of claim 19, further comprising a plurality of virtual counter electrodes corresponding to the counter electrodes, wherein the virtual counter electrodes have apertures located below the supplementary electrode.

21. The apparatus of claim 20 wherein an outermost virtual counter electrode has an outer diameter greater than an outer diameter of the wafer.

22. The apparatus of claim 20, further comprising an agitator between the virtual counter electrodes and the wafer holder.

23. An apparatus for electrochemically processing a microfeature wafer, comprising:

a vessel having a processing zone;

a wafer holder associated with the vessel to hold a wafer in the processing zone for electrochemical processing, with the vessel including a member having an inner edge, a rim above the inner edge, and a perimeter, and the vessel adapted to hold a processing fluid;

a mount above the member, with the mount and the member forming a compartment having a first flow outlet between the mount and the member through which processing fluid can exit the processing zone and flow over the perimeter of the member, and the mount including a brim defining a second flow outlet for processing fluid;

at least one counter electrode in the vessel;

a supplementary electrode in the compartment at a radial position between the inner edge and the perimeter, with the supplementary electrode operable independently from the counter electrode; and a supplementary virtual electrode in the processing zone configured to counteract an electric field offset relative to the wafer associated with an offset between the wafer and the counter electrode when the wafer is in the processing zone.

24. The apparatus of claim 23 wherein the supplementary virtual electrode has an aperture for shaping an electric field component from the supplementary electrode, and wherein the aperture is formed, at least in part, by the inner edge of the member.

* * * * *